United States Patent [19]

Simmell et al.

[11] Patent Number: 4,937,207

[45] Date of Patent: Jun. 26, 1990

[54] PORTABLE TOY VEHICLE RACING SET

[75] Inventors: Thomas L. Simmell, Milford; Robert McDarren, Ridgefield; David Auerbach, West Redding, all of Conn.

[73] Assignee: Link Group International, Ridgefield, Conn.

[21] Appl. No.: 305,821

[22] Filed: Feb. 3, 1989

[51] Int. Cl.[5] ..... A63H 33/04; A63H 18/00; A63F 9/14

[52] U.S. Cl. ..... 446/75; 446/444; 446/455; 104/DIG. 1; 105/1.5; 273/86 R

[58] Field of Search ..... 446/75, 74, 73, 72, 446/71, 77, 80, 444, 445, 446, 423, 455, 467, 454; 104/DIG. 1; 105/1.4, 1.5; 238/10 R, 10 A, 10 E, 10 F, 11, 12, 13, 14; 273/86 R

[56] References Cited

U.S. PATENT DOCUMENTS

| | | | |
|---|---|---|---|
| 1,444,654 | 2/1923 | Bradbury | 238/10 B |
| 2,590,676 | 3/1952 | Bradley | 238/10 A |
| 2,616,630 | 11/1952 | De Michele | 238/10 E X |
| 2,618,437 | 11/1952 | De Matthaeis | 238/10 A |
| 2,998,196 | 8/1961 | Eenigenburg | 238/10 E X |
| 3,074,200 | 1/1963 | Ziegenfuss | 238/10 A X |
| 3,402,503 | 9/1968 | Glass et al. | 273/86 B X |
| 4,285,157 | 8/1981 | Lambert | 238/10 A X |
| 4,349,983 | 9/1982 | Kilroy et al. | 446/75 |
| 4,365,438 | 12/1982 | Nelson | 446/75 |
| 4,382,599 | 5/1983 | Tilbor | 446/444 X |

FOREIGN PATENT DOCUMENTS

| | | | |
|---|---|---|---|
| 2196870 | 5/1988 | United Kingdom | 446/454 |

*Primary Examiner*—Robert A. Hafer
*Assistant Examiner*—D. Neal Muir
*Attorney, Agent, or Firm*—Blum Kaplan

[57] ABSTRACT

A portable toy vehicle racing set for use with at least one toy vehicle having a motor includes a case having a first section with inner and outer surfaces and a second section with inner and outer surfaces. The case sections are pivotally coupled together to permit movement between opened and closed positions. In the closed position, the set simulates a carrying case. In opened condition, a flat track surface is presented. The first and second sections of the case include predetermined track layouts which provide a closed loop track. The closed loop track defines at least one lane in which the toy vehicle can ride with the at least one lane including contact rails for supplying power to the toy vehicle motor.

19 Claims, 6 Drawing Sheets

PORTABLE TOY VEHICLE RACING SET

BACKGROUND OF THE INVENTION

The present invention relates generally to a portable toy vehicle racing set and, in particular, to a battery-powered toy vehicle racing set in which the components are housed in a portable case which folds open for use.

Toy vehicle racing sets such as slot car racing sets and the like generally include a plurality of track sections which must be selectively coupled together to form the racing track. The track sections include conductive rails which are electrically coupled together when the track sections are coupled to provide a closed track surface. Generally, power is supplied from an electrical power source through a transformer which is coupled to a house wiring circuit through a conventional plug. The speed of the cars on the track is controlled by a hand controller which includes a rheostat which varies the voltage applied across the tracks. The toy cars include motors which are coupled to the wheels of the vehicle. Power is supplied from the wheels through contact shoes to the motor.

Such racing car sets come packaged in large boxes and a significant amount of time is required to properly set up the track before play can begin. Because of the amount of time required to set up such a track, it is often required to leave the track in set up condition to avoid the time consuming procedure of dismantling the track, and reassembly when use is desired. Components are often bent or broken during the assembly and disassembly procedure and the play value is reduced because of this cumbersome and time consuming set-up procedure. In addition, such sets are not considered to be portable because of the set up requirements.

It would be desirable to provide a portable toy car racing set which is formed as part of a carrying case in which the track sections are formed as part of the case. The present invention provides such a system.

SUMMARY OF THE INVENTION

Generally speaking, in accordance with the present invention, a portable toy vehicle racing set for use with at least one toy vehicle having a motor therein, is provided. The racing set includes a case having a first section with inner and outer surfaces and a second section with inner and outer surfaces. The first and second sections are pivotally coupled together to permit movement of the first and second sections from a closed position where the case is closed to an open position where the first and second sections lie side by side with the inner surfaces thereof being essentially co-planar. The first section includes a first predetermined track layout and the second section includes a second predetermined track layout. The first and second track layouts form a closed loop track when the case is open. The closed loop track defines at least one lane in which a toy vehicle can ride. The lane includes contacts for supplying power from a power source to the motor of the toy vehicle.

In a preferred embodiment, the case sections are molded from a plastic material and the contacts are formed by conductive rails which lie along the track. A battery powered hand-held controller is coupleable to the rails to provide voltage thereto. The controller may include distinct contact positions whereby either one or two batteries can be coupled to the track section to simulate varying speeds for the toy vehicle.

In addition, the case sections may be releaseably coupled such that additional track sections may be coupled therebetween to provide a larger track layout.

Accordingly, it is an object of the present invention to provide a portable toy vehicle racing set.

Another object of the present invention is to provide a toy vehicle racing set in which the track sections are formed by the inner surfaces of a portable case.

A further object of the present invention is to provide a toy vehicle racing set in which the toy vehicles are powered by a hand-held battery-powered controller.

A still further object of the present invention is to provide a portable toy vehicle racing set formed in the shape of a carrying case which is molded from a plastic material.

A still further object of the present invention is to provide a portable toy vehicle racing set with enhanced play value.

Still other objects and advantages of the invention will in part be obvious and will in part be apparent from the specification.

The invention accordingly comprises features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 2:
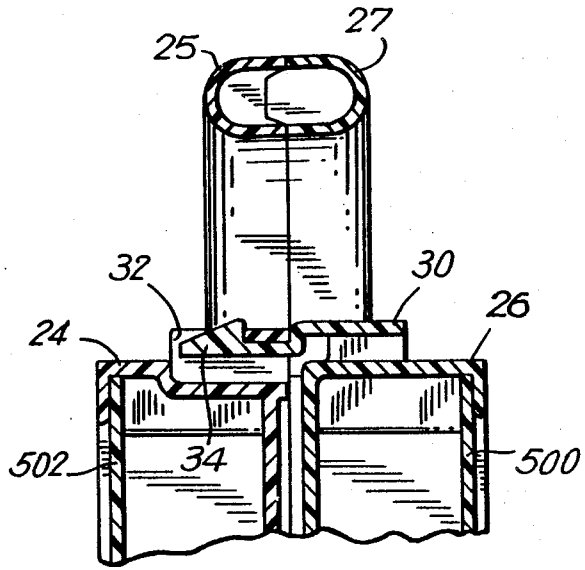
FIG. 2 is an enlarged sectional view taken along line 2—2 of FIG. 1.
Figure 1:
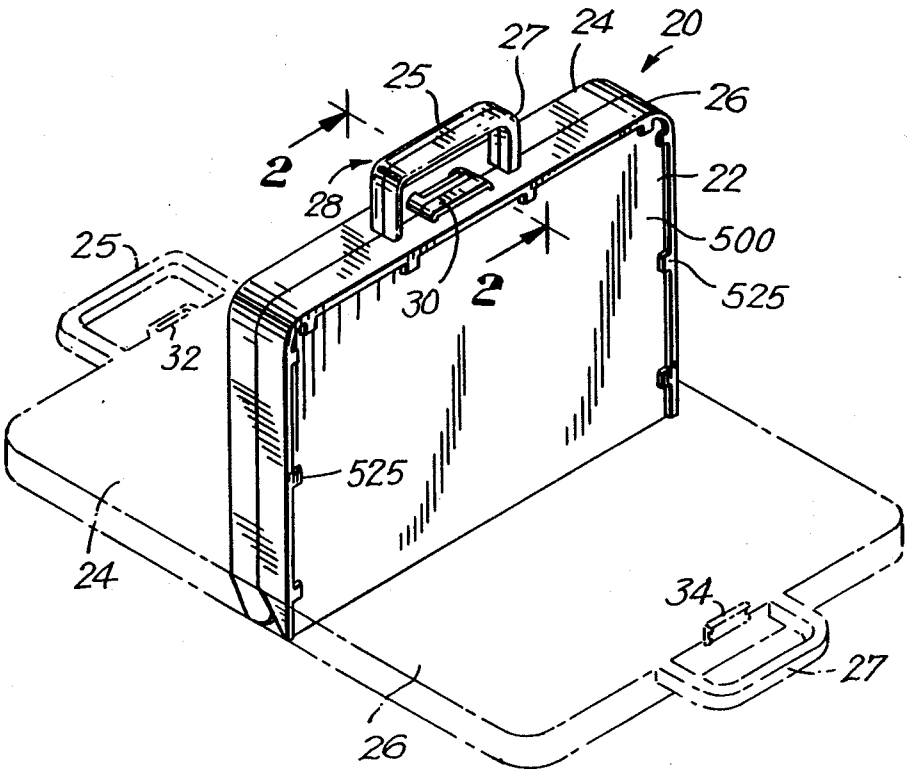
FIG. 1 is a perspective view of a portable toy car racing set constructed in accordance with a preferred embodiment of the present invention in which the open case is shown in phantom.

Reference is first made to FIG. 1 which depicts a toy vehicle racing set, generally indicated at 20, and constructed in accordance with a preferred embodiment of the present invention. Racing set 20 is formed as a carrying case 22 having a first case section 24 and a second case section 26.

First case section 24 includes a handle portion 25 and second case section 26 includes a handle portion 27 which together define a handle 28 used for carrying racing set 20. A releasable lock 30 defined by opening 32 formed in first case section 24 and latch 34 formed on second case section 26 is provided to lock the case in closed condition when such is desired.

Referring now to FIGS. 3 through 6, it is seen that first case section 24 includes an inner surface 40 which defines a first track section 42 having a first track 44 and a second track 46. Similarly, second case section 26 includes an inner surface 50 defining a second track section 52 which also defines a portion of a first track 44 and a second track 46. Track 44 is defined by a slot 60 formed in the inner surface 40 of first case section 24. First and second conductive rails 62 and 64 are positioned and fixed on opposite sides of slot 60. Second track 46 is likewise formed from a central slot 70 formed between parallel conductive rails 72 and 74 disposed on opposite sides of slot 70.

Figure 6:
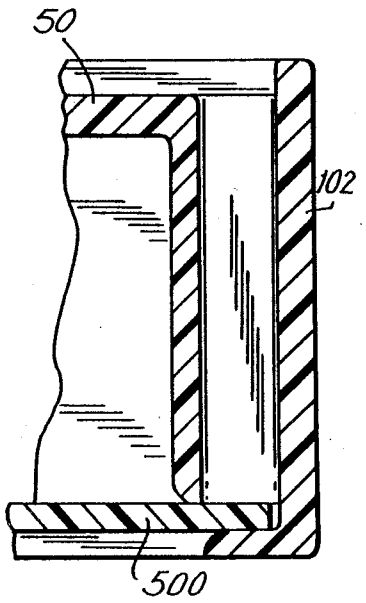
FIG. 6 is an enlarged sectional view taken along line 6—6 of FIG. 3.
Figure 4:
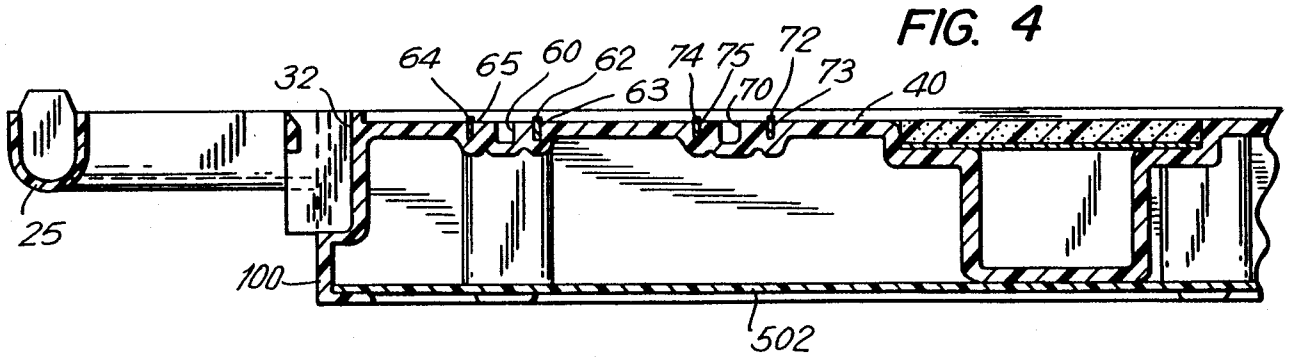
FIG. 4 is an enlarged sectional view taken along line 4—4 of FIG. 3.
Figure 11:
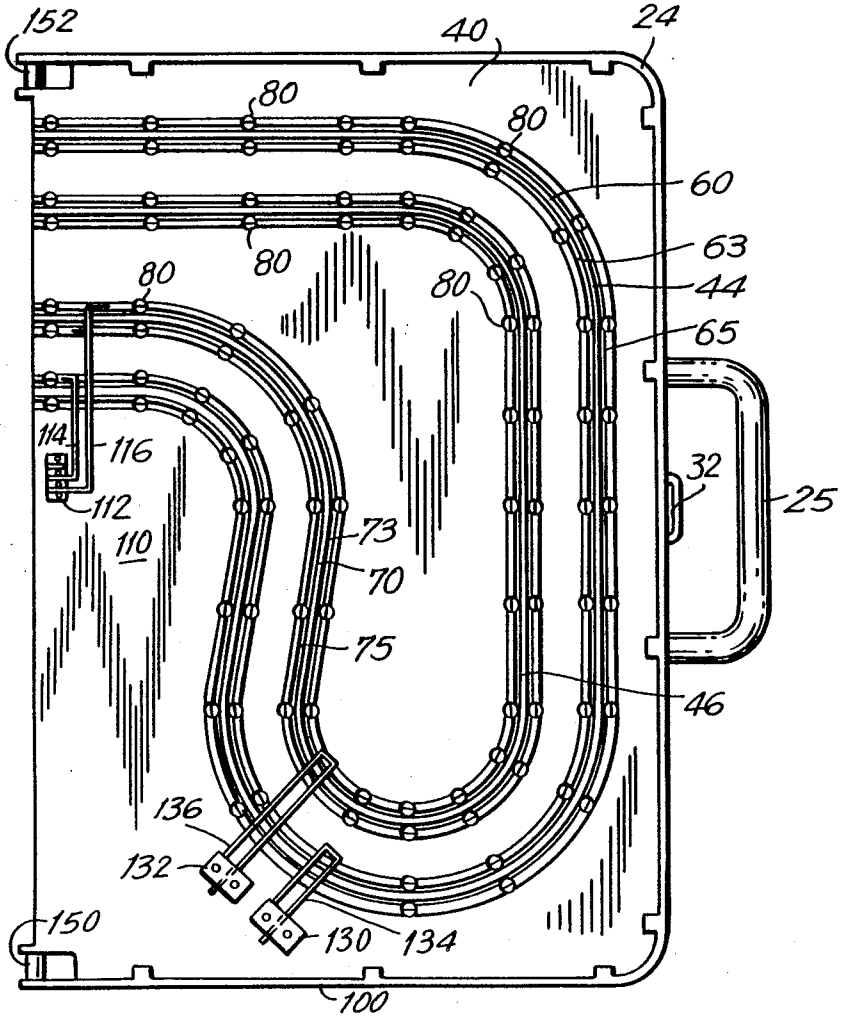
FIG. 11 is a bottom plan view of the under surface of one section of the case.

As best seen in FIGS. 4, 6 and 11, the inner surface 40 is formed integrally with sidewall 100 which forms the outer periphery of carrying case 22. Slots 60 and 70 are molded in inner surface 40 and narrow slots 63 and 65 are formed on opposite sides of slot 60 to permit conductive rails 62 and 64 to be positioned and held therein. Likewise, narrow slots 73 and 75 are formed on opposite sides of slot 70 to permit contact rails 72 and 74 to be positioned respectively therein and locked thereto. As best depicted in FIG. 11, it is seen that contact rails 62, 64, 72 and 74 are staked in their respective narrow slots at a plurality of staking points 80. This prevents the contact rails from becoming dislodged from the respective slots in which they are positioned. It is noted that with respect to the foregoing description, first case section 24 is constructed similarly to second case section 26. In FIG. 6, the inner surface is designated at 50 and the sidewall is designated at 102. It is also noted that although two lanes are shown, the invention is not limited to this number of lanes.

Figure 3:
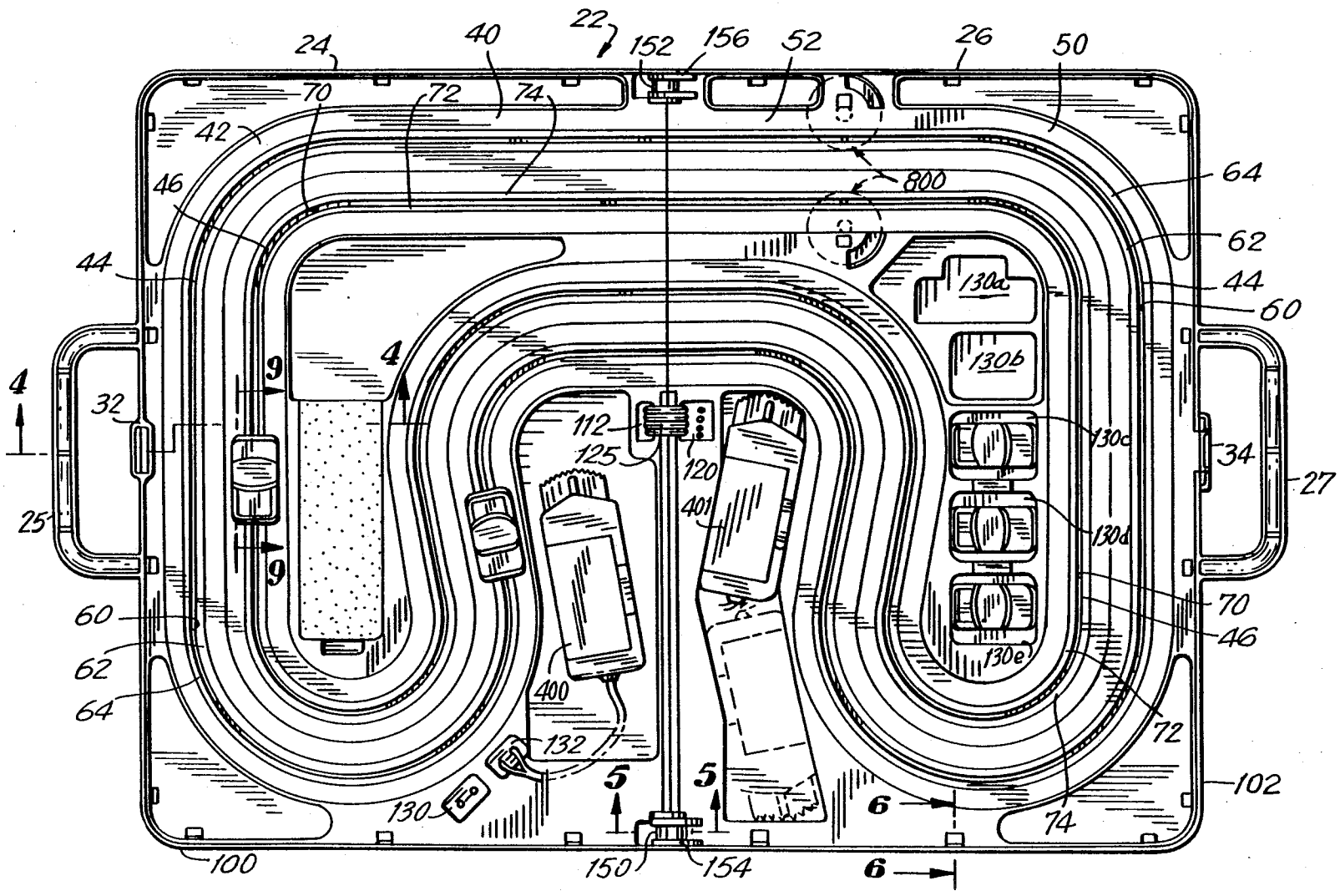
FIG. 3 is a top plan view of the toy vehicle racing set of the present invention with the case shown in open condition.

In manufacturing the set, the two case sections are first molded from a plastic material leaving the underside 110 of inner surface 40 exposed from behind. The rails are then inserted in their appropriate slots and are then staked. As best depicted in FIG. 11, an electrical coupling is made between the four tracks and a coupling socket 112 through wire junctions 114 and 116. Once again, second case section 26 similarly includes a socket 120 which is coupled through appropriate wire junctions to the contact rails thereon. A plug 125 is coupled intermediate socket 112 and socket 120 to close the loop of electrical contact so that each rail forms a continuous electrical path. In folded condition as depicted in FIG. 1, plug 125 is removed and stored in one of a plurality of depressions **130*a* through 130*e* formed in second case section 26. These depressions can also be utilized to store the toy vehicles. When the case is folded open as depicted in FIG. 3, plug 125 is then interconnected between socket 112 and socket 120** to provide the appropriate electrical coupling.

First case section 24 also includes first controller socket 130 and second controller socket 132 which are appropriately coupled to the respective rails through wire 134 and 136 as best depicted in FIG. 11.

Figure 5:
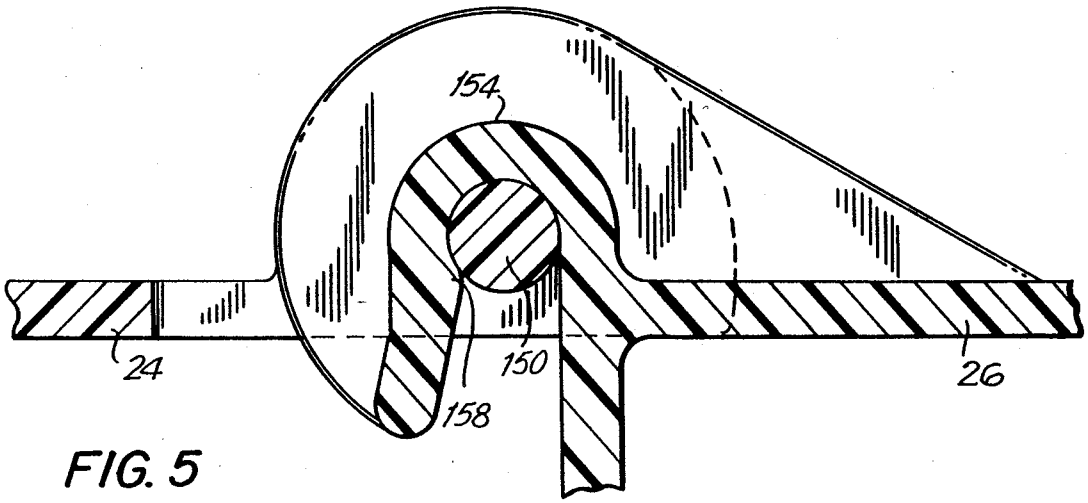
FIG. 5 is an enlarged sectional view taken along line 5—5 of FIG. 3.

An additional advantage of the present invention is that first and second case sections 24 and 26 are releaseably pivotably coupled together so that the sections can be uncoupled when desired. In this regard, first case section 24 includes first and second posts 150 and 152 at opposite edges thereof which releaseably mate, respectively in U-shaped projections 154 and 156 as best depicted in FIG. 3. FIG. 5 depicts that U-shaped projection 154 includes a bulge 158 on the internal surface thereof to provide a snap-locking effect. U-shaped member 156 can provide a similar snap-locking effect. These hinges permit the case to be pivoted between opened and closed position, while also permitting the case section to be separated.

Figure 12:
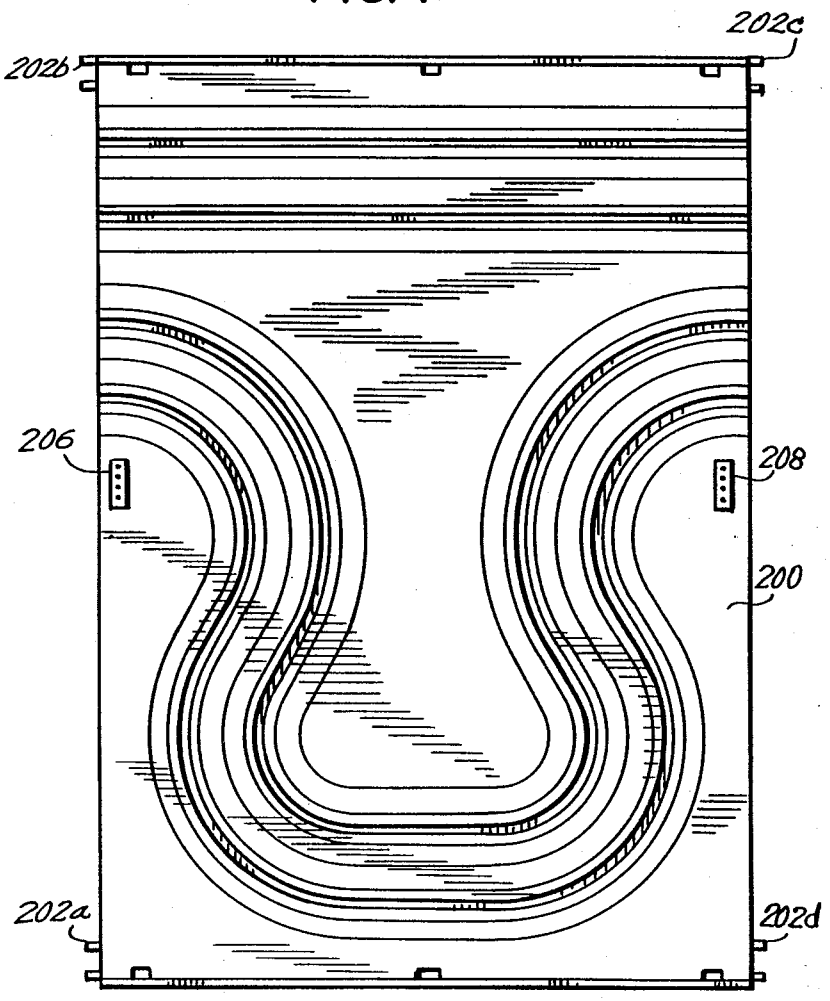
FIG. 12 is a top plan view of an additional track section for use in conjunction with the present invention.

One major advantage of permitting separation of the cases is to permit additional track section such as track section 200 depicted in FIG. 12 to be coupled intermediate the two case halves. In fact, a plurality of such additional track sections can be coupled intermediate to provide a larger layout and enhanced play value. Each additional track section will include appropriate hinge members **202*a* through 202*d* to permit appropriate mechanical coupling, and electrical coupling sockets 206 and 208 to permit electrical coupling between the respective track sections using additional plugs 125**. The only requirement is that the track slots and rails line up from edge to edge so that toy vehicles riding thereon can be provided with a continuous path.

Figure 9:
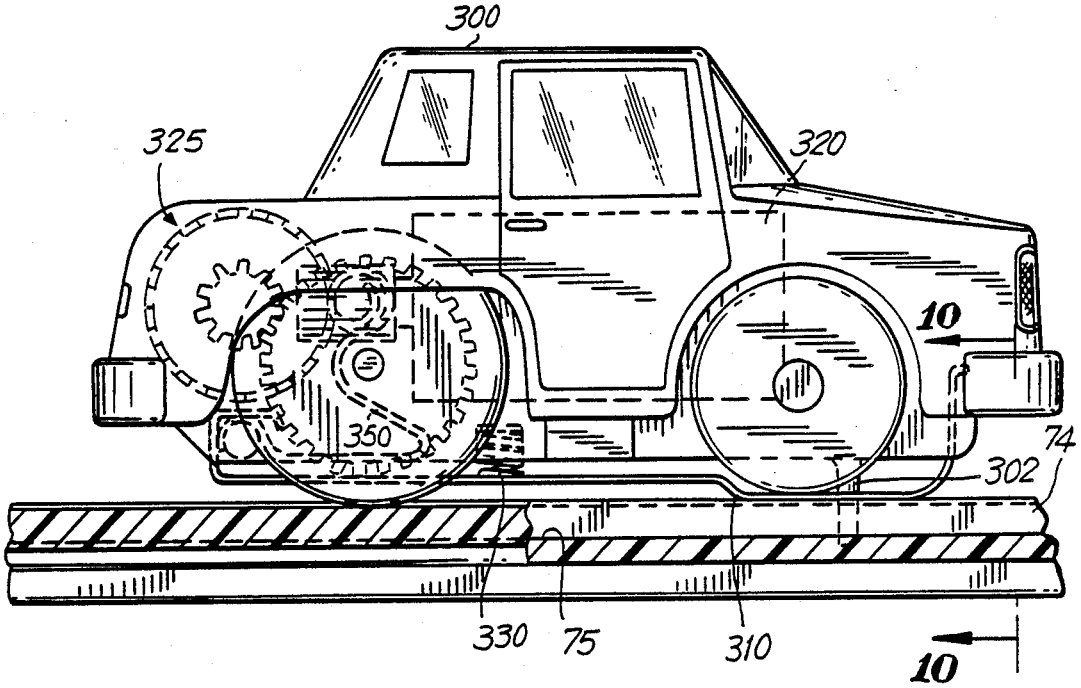
FIG. 9 is an enlarged sectional view of a toy vehicle shown riding on a track section taken along line 9—9 of FIG. 3.
Figure 10:
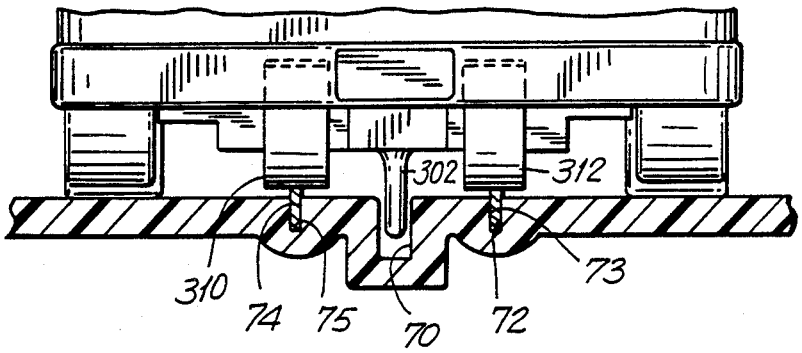
FIG. 10 is a sectional view taken along line 10—10 of FIG. 9.

Reference is now made to FIGS. 9 and 10 to describe the manner in which a toy vehicle 300 rides on the track. The toy vehicle includes a downwardly projecting pin 302 which rides in slot 70 to guide vehicle 300 along the track. First and second contact shoes 310 and 312 respectively contact rail 74 and rail 72. Voltage applied between rails 72 and 74 are likewise applied between contact shoes 310 and 312 and ultimately supplied to a motor 320 depicted in phantom in FIG. 9. Motor 320 is coupled through a gear train generally indicated at 325 to drive the wheels of the vehicle. As best depicted in FIG. 9, it is seen that contact shoe 310 is biased downwardly against rail 74 by a spring 330. Contact shoe 310 is bent and configured as depicted in FIG. 9 and contacts a second conductive leaf 350 which is coupled to motor 320.

Figure 8:
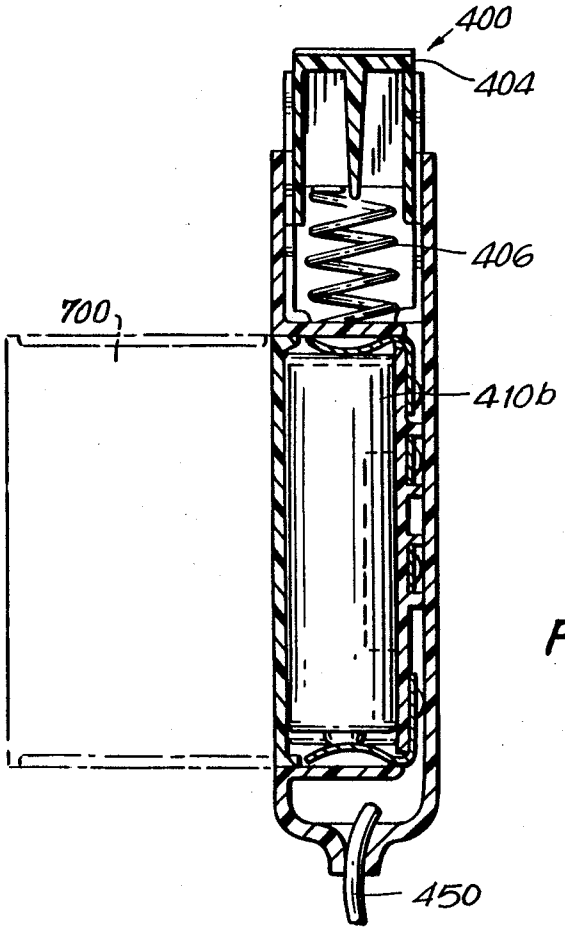
FIG. 8 is a sectional view taken along line 8—8 of FIG. 7.
Figure 7:
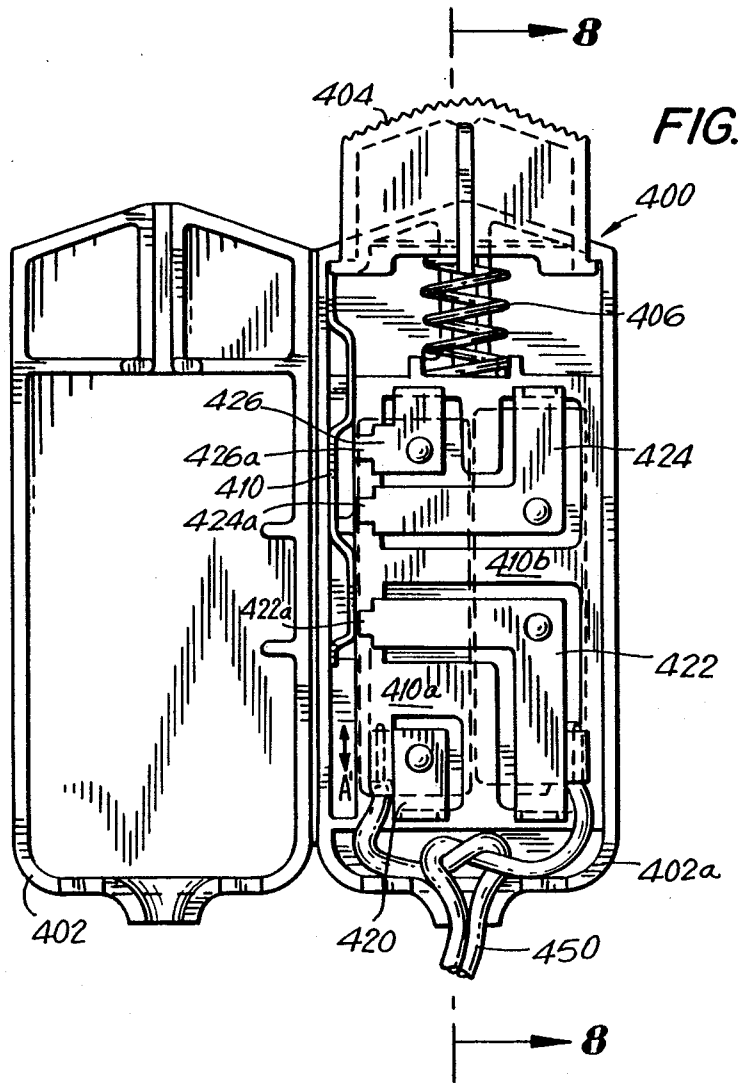
FIG. 7 is an elevational view of a hand-held controller for use with the toy vehicle racing set of the present invention shown in open position.

Referring now to FIGS. 7 and 8, details of a particular controller generally indicated at 400 which may be used in conjunction with the toy car racing set of the present invention will be described. Controller 400 is formed in a plastic case 402 and **402*a* pivotally coupled together and includes a spring biased button 404 through a spring 406. Also coupled to switch button 404 is a specially configured contact strip 410. Controller 402 is adapted to house two AA batteries 410*a* and 410*b*. A first contact 420 is coupled to the negative side of first battery 410*a*. A second contact 422 is coupled to the positive end of second battery 410*b*. A third contact 424 is coupled to the negative side of battery 410*b*. Finally, a fourth terminal 426 is coupled to the positive terminal of battery 410*a***.

Projections **422*a*, 424*a* and 426*a* extend from terminals 422, 424 and 426 respectively. When spring button 404 is depressed and contact strip 410 is moved in the direction of arrow A, either one battery or both batteries together will be used to provide power. In this way, the controller can be used to simulate a conventional rheostat by adjusting the power supply to the track. Controller 400 also includes a battery door 700**.

Wires 450 extend from controller 400 and are plugged into controller socket 130 or 132. A second controller 401 is provided for plugging in the other of controller sockets 130 and 132. Each of the controllers will control one lane of the track so that racing between two participants can be had. Storage slots are also provided in the case for storing the controllers. It is noted that other types of controllers including those with a rheostat may be used in the present invention. Moreover, the batteries may be housed in the case itself.

As depicted in FIGS. 1, 4 and 6, after the molding of the two case halves and the insertion of the various metal components, backplates 500 are slid into place to form the outer surface of the case. These panels are held in place by a plurality of lips 525. In this fashion, the entire case except for the outer back panels can be molded integrally to reduce and simplify manufacturing.

Each lane on the track may include a lap counter as shown at 800 in FIG. 3 to further enhance the play value of the system.

The present invention as described in detail above provides a toy vehicle racing set which is readily portable through the provision of providing the track built in a portable case with handles. The case is easy to manufacture and the play value of the toy racing set is substantially enhanced by permitting the case halves to separate with additional sections being added.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A portable toy vehicle racing set for use with at least one toy vehicle having a motor means comprising a case having a first case section with an inner surface and an outer surface spaced apart and separate from said inner surface and a first peripheral wall, and a second case section with an inner surface and an outer surface spaced apart and separate from said inner surface and a second peripheral wall, said peripheral walls and said surfaces forming a void utilizable for storage coupling means for pivotally coupling said first case section to said second case section to permit movement of said first and second case sections from a closed position where said inner surface of said first case section faces said inner surface of said second case section and said first and second peripheral walls essentially mate to present a closed case to an open position where said first and second case sections lie side by side with said inner surfaces of said first and second case sections being essentially co-planar, said inner surface of said first case section including a first predetermined track layout and said inner surface of said second case section including a second predetermined track layout, said first and second track layouts on said inner surfaces forming a closed loop track when said case is in said open position, said closed loop track defining at least one lane in which said toy vehicle can ride, said at least one lane including contact means for supplying power to said motor means of said toy vehicle.

2. The toy vehicle racing set as claimed in claim 1, wherein said coupling means permits said first case section to be decoupled from said second case section.

3. The toy vehicle racing set as claimed in claim 2, wherein said coupling means includes a post on said first case section and a U-shaped member which releaseably captures said post on said second case section.

4. The toy vehicle racing set as claimed in claim 1, wherein said first and second case sections each include an outer edge defining the outer periphery of said case, said inner surfaces being formed integrally with said respective outer edge.

5. The toy vehicle racing set as claimed in claim 4, wherein said first and second case sections each include an outer surface, each outer surface being formed by separate slide-in panels.

6. The toy vehicle racing set as claimed in claim 1, wherein said closed loop track is defined by a continuous slot formed in both said inner surfaces which becomes a continuous closed loop when said case is in said open condition.

7. The toy vehicle racing set as claimed in claim 6, wherein said inner surfaces further include recessed narrow slots on opposite sides of said continuous slot, said contact means including electrically conductive rails positioned in said narrow slots.

8. The toy vehicle racing set as claimed in claim 7, wherein said conductive rails are fixedly positioned within said narrow slots.

9. The toy vehicle racing set as claimed in claim 6, wherein said toy vehicle includes a pin adapted to ride in said continuous slot around said closed loop track.

10. The toy vehicle racing set as claimed in claim 1, further comprising controller means coupled to said contact means for controlling the power supplied thereto.

11. The toy vehicle racing set as claimed in claim 10, wherein said controller means includes a spring-biased switch means, further comprising first and second battery holders, said switch means being displaceable between a first position where said first and second battery holders are not coupled to said contact means, a second position where said first battery holder is coupled to said contact means, and a third position where both said first and second battery holder are coupled to said contact means.

12. The toy vehicle racing set as claimed in claim 1, wherein said inner surfaces of said first and second case sections are essentially co-planar when in said open position.

13. The toy vehicle racing set as claimed in claim 2, further comprising a third case section adapted to be coupled intermediate said first and second case sections.

14. The toy vehicle racing set as claimed in claim 1, further comprising interlocking handle means coupled to said first and second case sections for carrying said case when in its closed position.

15. A portable toy vehicle racing set for use with at least one toy vehicle having a motor means comprising a case having a first case section with inner and outer surfaces and a second case section with inner and outer surfaces, coupling means for pivotally coupling said first case section to said second case section to permit movement of said first and second case sections from a closed position where said inner surface of said first case section faces said inner surfaces of said second case section to an open position where said first and second case sections lie side by side, said first case section including a first predetermined track layout and said second case section including a second predetermined track layout, said first and second track layouts forming a closed loop track when said case is in said open position, said closed loop track defining at least one lane in which said toy vehicle can ride, said at least one lane including contact means for supplying power to said motor means of said toy vehicle, said contact means including electrically conductive rails extending along said at least one lane, further comprising a first socket on said first case section coupled to said conductive rails thereon, a second socket on said second case section coupled to said conductive rails thereon, and plug means for releaseably electrically coupling said first socket to said second socket.

16. A portable toy vehicle racing set for use with at least two toy vehicles each having a motor means comprising a case having a first case section with inner and outer surfaces spaced apart from one another and a first peripheral wall therebetween and a second case section with inner and outer surfaces spaced apart from one another and a second peripheral wall therebetween, said peripheral walls and said surfaces forming a void utilizable for storage, coupling means for pivotally coupling said first case section to said second case section to permit movement of said first and second case sections from a closed position where said inner surface of said first case section faces said inner surface of said second case section and said first and second peripheral walls essentially mate to present a closed case to an open position where said first and second case sections lie side by side and said inner surfaces are essentially coplanar, said first case section including a first predetermined track layout defining two lanes and said second case section including a second predetermined track layout defining two lanes, said first and second track layouts forming two closed loop lanes when said case is in said open position in which said first and second toy vehicles can ride, respectively, each said lane including contact means for supplying power to said motor means of said toy vehicle riding thereon.

17. The portable toy vehicle racing set as claimed in claim 16, wherein said coupling means is separable to permit coupling of at least one additional track section intermediate said first and second case sections, said additional track section including a track layout thereon interconnectable to said first and second predetermined track layouts to form two closed loop lanes.

18. The portable toy vehicle racing set as claimed in claim 16, further including controller means coupled to said contact means to control said power with self-contained power-supply means.

19. A portable toy vehicle racing set for use with at least two toy vehicles each having a motor means comprising a case having a first case section with inner and outer surfaces spaced apart from one another and a first peripheral wall therebetween and a second case section with inner and outer surfaces spaced apart from one another and a second peripheral wall therebetween, said peripheral walls and said surfaces forming a void utilizable for storage, coupling means for pivotally coupling said first case section to said second case section to permit movement of said first and second case sections from a closed position where said inner surface of said first case section faces said inner surface of said second case section and said first and second peripheral walls essentially mate to present a closed case to an open position where said first and second case sections lie side by side and said inner surfaces are essentially coplanar, said first case section including a first predetermined track layout defining two lanes and said second case section including a second predetermined track layout defining two lanes, said first and second track layouts forming two closed loop lanes when said case is in said open position in which said first and second toy vehicles can ride, respectively, each said lane including contact means for supplying power to said motor means of said toy vehicle riding thereon, said coupling means being separable to permit coupling of at least one additional track section intermediate said first and second case sections, said additional track section including a track layout thereon interconnectable to said first and second predetermined track layouts to form two closed loop lanes, and controller means coupled to said contact means to control said power with self-contained power-supply means therein.

* * * * *